US009900693B2

(12) United States Patent
Ishizaki

(10) Patent No.: US 9,900,693 B2
(45) Date of Patent: Feb. 20, 2018

(54) XY-TYPE MICROPHONE UNIT AND SOUND RECORDING APPARATUS

(71) Applicant: TEAC CORPORATION, Tokyo (JP)

(72) Inventor: Hironao Ishizaki, Tokyo (JP)

(73) Assignee: TEAC Corporation, Tokyo (JP)

( * ) Notice: Subject to any disclaimer, the term of this patent is extended or adjusted under 35 U.S.C. 154(b) by 0 days.

(21) Appl. No.: 15/477,523

(22) Filed: Apr. 3, 2017

(65) Prior Publication Data

US 2017/0289685 A1 Oct. 5, 2017

(30) Foreign Application Priority Data

Apr. 4, 2016 (JP) ..... 2016-075275

(51) Int. Cl.
*H04R 5/00* (2006.01)
*H04R 5/027* (2006.01)
*H04R 1/32* (2006.01)

(52) U.S. Cl.
CPC ..... *H04R 5/00* (2013.01); *H04R 1/32* (2013.01); *H04R 5/027* (2013.01)

(58) Field of Classification Search
CPC ..... H04R 5/027
See application file for complete search history.

(56) References Cited

U.S. PATENT DOCUMENTS

2010/0008511 A1 1/2010 Kawano

FOREIGN PATENT DOCUMENTS

| | | | |
|---|---|---|---|
| JP | 2007-043510 | a | 2/2007 |
| JP | 1396752 | S | 9/2010 |
| JP | 4753978 | B2 | 8/2011 |

*Primary Examiner* — Mohammad Islam
(74) *Attorney, Agent, or Firm* — Seed Intellectual Property Law Group LLP

(57) ABSTRACT

An XY-type microphone unit and a sound recording apparatus are provided which can effectively record a high-res sound source or the like. The XY-type microphone unit includes a left microphone unit and a right microphone unit. The left microphone unit includes a high-band microphone unit of the left microphone unit which collects sounds of a high band and a low-band microphone unit of the left microphone unit which collects sounds of low band. The right microphone unit includes a high-band microphone unit of the right microphone unit which collects sounds of a high band and a low-band microphone unit of the right microphone unit which collects sounds of a low band. Vibration plates of the high-band microphone unit, the low-band microphone unit, the high-band microphone unit, and the low-band microphone unit are placed on approximately the same straight line in a plan view.

6 Claims, 3 Drawing Sheets

XY-TYPE MICROPHONE UNIT AND SOUND RECORDING APPARATUS

CROSS REFERENCE TO RELATED APPLICATION

The entire disclosure of Japanese Patent Application No. 2016-075275 filed on Apr. 4, 2016, including the specification, claims, drawings, and abstract, is incorporated herein by reference in its entirety.

TECHNICAL FIELD

The present disclosure relates to an XY-type microphone unit and a sound recording apparatus.

BACKGROUND

In the related art, an XY-type microphone unit is known.

JP 4753978 B discloses an XY-type microphone unit for stereo recording, wherein a right microphone unit and a left microphone unit are disposed to be piled in the up-and-down direction, to prevent occurrence of a middle omission phenomenon in which sounds of middle sections on the left and right are omitted.

JP 2007-043510 A discloses a structure in which a pair of microphones are attached on a rail in a movable manner so that the microphones can be placed in an XY-type arrangement and an AB-type arrangement.

In recent years, however, high-resolution audio (hereinafter, also referred to as "high-res") apparatuses are proposed, and high-res microphone units for recording high-res sound sources are also proposed. Thus, there may be a problem in how the high-res microphone unit is attached on the sound recording apparatus.

SUMMARY

An advantage of the present disclosure lies in the provision of an XY-type microphone unit and a sound recording apparatus which can effectively record a high-res sound source or the like.

According to one aspect of the present disclosure, there is provided an XY-type microphone unit in which a pair of left and right microphones are placed with respective sound pickup axes substantially crossing each other, the XY-type microphone unit comprising: a left microphone unit; and a right microphone unit, wherein the left microphone unit comprises at least: a high-band microphone unit of the left microphone unit that collects sounds of a relatively high band, and a low-band microphone unit of the left microphone unit that collects sounds of a relatively low band; the right microphone unit comprises at least: a high-band microphone unit of the right microphone unit that collects sounds of a relatively high band, and a low-band microphone unit of the right microphone unit that collects sounds of a relatively low band; and vibration plates of the high-band microphone unit of the left microphone unit, the low-band microphone unit of the left microphone unit, the high-band microphone unit of the right microphone unit, and the low-band microphone unit of the right microphone unit are placed on an approximate same straight line in a plan view.

According to another aspect of the present disclosure, the high-band microphone unit of the left microphone unit is fixed at a predetermined position of the low-band microphone unit of the left microphone unit, the high-band microphone unit of the right microphone unit is fixed at a predetermined position of the low-band microphone unit of the right microphone unit, and the high-band microphone unit of the left microphone unit and the high-band microphone unit of the right microphone unit are placed at an outer side in a plan view with respect to the low-band microphone unit of the left microphone unit and the low-band microphone unit of the right microphone unit.

According to another aspect of the present disclosure, the high-band microphone unit of the left microphone unit is fixed at a predetermined position of the low-band microphone unit of the left microphone unit, the high-band microphone unit of the right microphone unit is fixed at a predetermined position of the low-band microphone unit of the right microphone unit, and the high-band microphone unit of the left microphone unit and the high-band microphone unit of the right microphone unit are placed at an inner side in a plan view with respect to the low-band microphone unit of the left microphone unit and the low-band microphone unit of the right microphone unit.

According to another aspect of the present disclosure, the high-band microphone unit of the left microphone unit is fixed at a predetermined position of the low-band microphone unit of the left microphone, the high-band microphone unit of the right microphone unit is fixed at a predetermined position of the low-band microphone unit of the right microphone unit, and the high-band microphone unit of the left microphone unit and the high-band microphone unit of the right microphone unit are placed in a manner to allow switching between an outer side and an inner side in a plan view with respect to the low-band microphone unit of the left microphone unit and the low-band microphone unit of the right microphone unit.

According to another aspect of the present disclosure, the high-band microphone unit of the left microphone unit and the high-band microphone unit of the right microphone unit collect sounds of higher than or equal to 40 kHz, and the low-band microphone unit of the left microphone unit and the low-band microphone unit of the right microphone unit collect sounds of lower than 40 kHz.

According to another aspect of the present disclosure, there is provided a sound recording apparatus comprising the above-described XY-type microphone unit.

According to various aspects of the present disclosure, a high-res sound source or the like can be effectively recorded. In particular, according to the present disclosure, the middle omission phenomenon in which sounds of the left and right middle sections are omitted can be effectively prevented even for the high-res sound source or the like.

BRIEF DESCRIPTION OF DRAWINGS

Embodiment(s) of the present disclosure will be described with reference to the following figures, wherein.

DESCRIPTION OF EMBODIMENTS

An embodiment of the present disclosure will now be described with reference to the drawings.

Figure 1A:
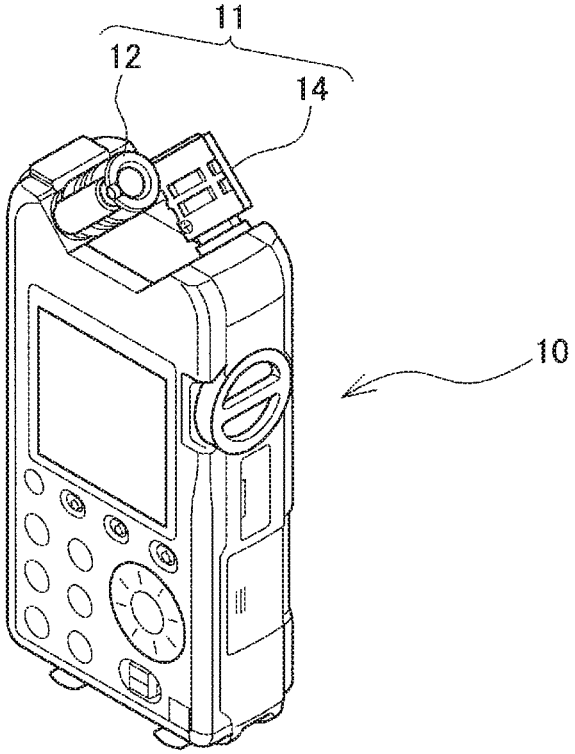
FIG. 1A is a perspective view (part 1) of a portable sound recording apparatus according to an embodiment of the present disclosure.
Figure 1B:
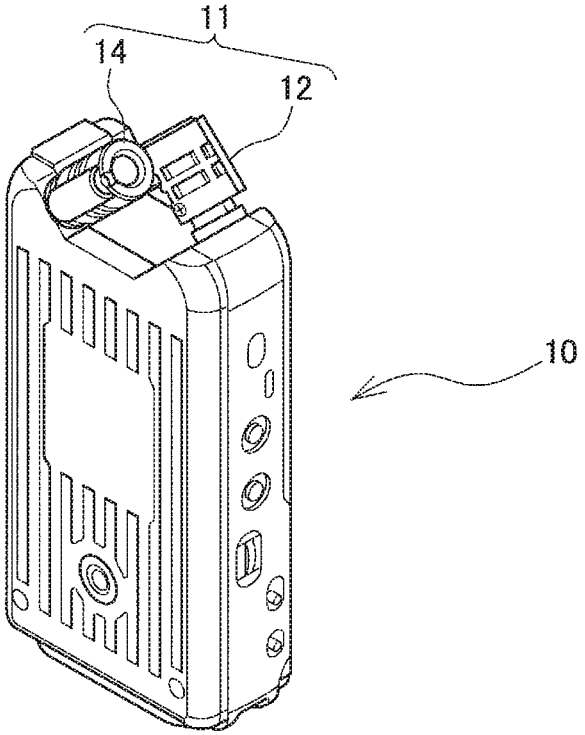
FIG. 1B is a perspective view (part 2) of the portable sound recording apparatus according to the embodiment of the present disclosure.

FIGS. 1A and 1B are perspective views showing a high-res portable sound recording apparatus 10 equipped with an XY-type microphone unit according to the present embodiment. FIG. 1A is a perspective view viewed from the front side and FIG. 1B is a perspective view viewed from the back side.

In the following description, the following terms are to be used in the following meanings.

"XY-type microphone"

An XY-type microphone refers to a microphone in which a pair of left and right microphones are placed in a reverse V-shape with the respective sound pickup axes crossing each other. The sound pickup axis refers to a virtual axis which extends vertically from a surface of a vibration plate for detecting sound.

"High-Resolution (High-Res)"

High-resolution (high-res) means that the following performances are assured in sound recording and reproducing devices and in the transmission system:

<Analog System>

(1) that, for a high-band frequency performance of the sound recording microphone, 40 kHz or higher is possible;

(2) that, for the high-band reproduction performance of the amplifier, 40 kHz or higher is possible; and (3) that, for the high-band reproduction performance of the speaker and headphone, 40 kHz or higher is possible; and <Digital System>

(1) that, for the sound recording format, FLAC or WAV file with 96 kHz/24 bits or greater is possible;

(2) that, for an input/output I/F, 96 kHz/24 bits or greater is possible;

(3) that, for the file reproduction, FLAC or WAV file with 96 kHz/24 bits can be handled;

(4) that, for signal processing, signal processing performance of 96 kHz/24 bits or greater is possible; and (5) that, for the digital to analog conversion, 96 kHz/24 bits or greater is possible.

The high-res portable sound recording apparatus 10 shown in FIGS. 1A and 1B comprises a microphone unit 11 of an XY type attached at an upper end of a body.

The high-res portable sound recording apparatus 10 has an outer appearance shape of an approximate rectangular parallelepiped, and a liquid crystal panel for displaying statuses such as a sound recording level and various operation switches and buttons are provided at the front of the apparatus. The operation switches includes switches for starting/stopping sound recording, reproducing, temporarily stopping, or the like. The high-res portable sound recording apparatus 10 comprises a known analog signal processor circuit and a known digital signal processor circuit, and records the sound by recording an audio signal which is input from the microphone unit 11 as digital data in a built-in storage medium or an SD memory or the like equipped on an SD card slot.

The XY-type microphone unit 11 includes a left microphone unit 12 and a right microphone unit 14, and the left microphone unit 12 and the right microphone unit 14 are placed with respective sound pickup axes approximately orthogonal to each other. The left microphone unit 12 collects sounds generated from the front right side and the right microphone unit 14 collects sounds generated from the front left side.

The left microphone unit 12 and the right microphone unit 14 are placed along the up-and-down direction such that the left microphone unit 12 is piled over the right microphone unit 14, to prevent the middle omission phenomenon in which the left and right middle section sounds are omitted.

Moreover, in the present embodiment, each of the left microphone unit 12 and the right microphone unit 14 comprises a microphone unit which primarily collects sounds of lower than 40 kHz and a microphone unit which primarily collects sounds of higher than or equal to 40 kHz.

Figure 2:
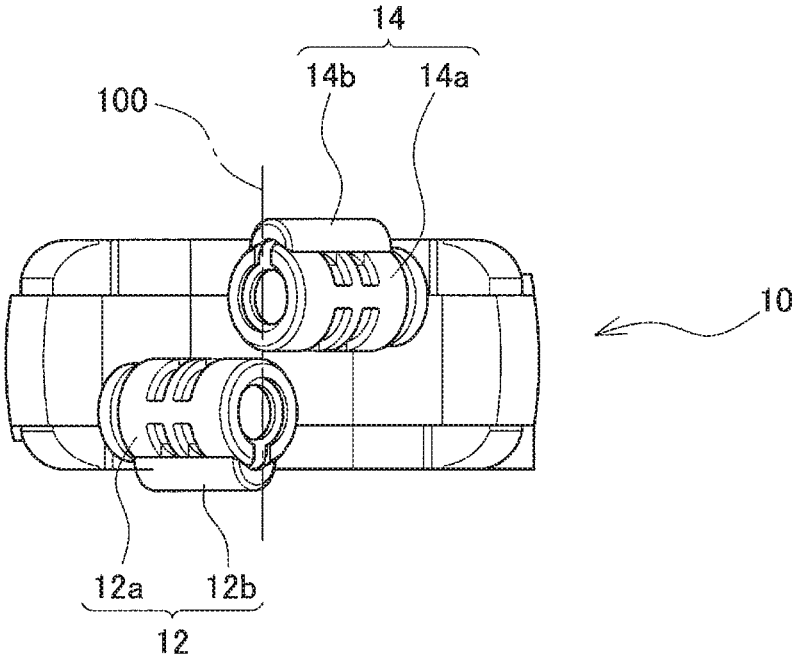
FIG. 2 is a plan view of the portable sound recording apparatus according to the embodiment of the present disclosure.

FIG. 2 is a plan view of the high-res portable sound recording apparatus 10 of the present embodiment. The left microphone unit 12 comprises a microphone unit 12*a* which primarily collects sounds of lower than 40 kHz, and a microphone unit 12*b* which primarily collects sounds of higher than or equal to 40 kHz. The microphone unit 12*b* is fixed to a part of a side surface of the microphone unit 12*a* having an approximate circular tube shape. The microphone unit 12*a* and the microphone unit 12*b* are fixed in such a manner that a sound pickup axis of the microphone unit 12*a* and a sound pickup axis of the microphone unit 12*b* are parallel to each other. Similarly, the right microphone unit 14 comprises a microphone unit 14*a* which primarily collects sounds of lower than 40 kHz and a microphone unit 14*b* which primarily collects sounds of higher than or equal to 40 kHz. The microphone unit 14*b* is fixed to a part of a side surface of the microphone unit 14*a* having an approximate circular tube shape. The microphone unit 14*a* and the microphone unit 14*b* are fixed in such a manner that a sound pickup axis of the microphone unit 14*a* and a sound pickup axis of the microphone unit 14*b* are parallel to each other.

As described above, the left microphone unit 12 and the right microphone unit 14 are placed along the up-and-down direction such that the left microphone unit 12 is piled over the right microphone unit 14 (as FIG. 2 is a plan view, the left microphone unit 12 is placed below the right microphone unit 14 in FIG. 2). In this configuration, a center of a vibration plate of the microphone unit 12*a* of the left microphone unit 12 and a center of a vibration plate of the microphone unit 14*a* of the right microphone unit 14 are positioned on a central axis 100 in the left-and-right direction of the high-res portable sound recording apparatus 10, and, in addition, a center of a vibration plate of the microphone unit 12*b* of the left microphone unit 12 and a center of a vibration plate of the microphone unit 14*b* of the right microphone unit 14 are positioned on the central axis 100 in the left-and-right direction of the high-res portable sound recording apparatus 10. Specifically, in general, the microphone unit includes a microphone body having an outer appearance of an approximate circular tube shape and a vibration plate formed at an upper end of the body, and, when the center of the vibration plate of the microphone unit 12*a* of the left microphone unit 12 is denoted by G12*a*, the center of the vibration plate of the microphone unit 12*b* is denoted by G12*b*, the center of the vibration plate of the microphone unit 14*a* of the right microphone unit 14 is denoted by G14*a*, and the center of the vibration plate of the microphone unit 14*b* of the right microphone unit 14 is denoted by G14*b*, the centers are placed in the order of G14*b*, G14*a*, G12*a*, and G12*b* in the up-and-down direction in FIG. 2, and all of G14*b*, G14*a*, G12*a*, and G12*b* are placed on the central axis 100.

With such a configuration, it is possible to prevent the middle omission phenomenon, in which the left and right middle section sounds are omitted, for sounds primarily of lower than 40 kHz, and also to prevent the middle omission phenomenon, in which the left and right middle section sounds are omitted, for sounds primarily of higher than or equal to 40 kHz. In other words, the phase deviation between the sounds primarily of lower than 40 kHz and the sounds primarily of higher than or equal to 40 kHz can be prevented.

Figure 3:
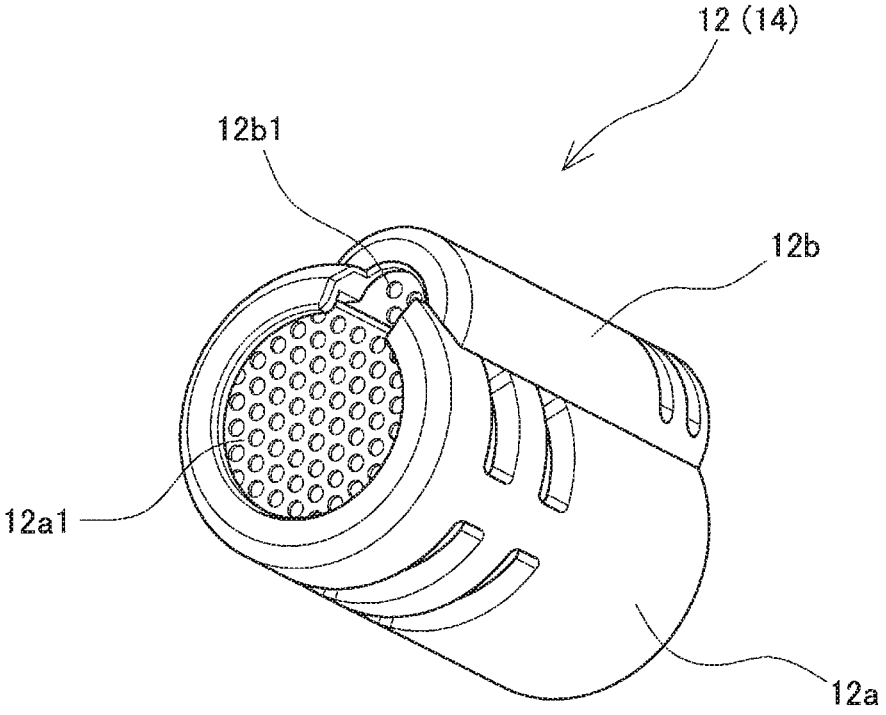
FIG. 3 is an enlarged perspective view of a microphone unit according to the embodiment of the present disclosure.

FIG. 3 is an enlarged outer appearance perspective view of the left microphone unit 12. The right microphone unit 14 has a similar structure.

The left microphone unit 12 is formed as a whole with the microphone unit 12*a* having an outer appearance of an approximate circular tube shape, and the microphone unit 12*b* fixed at a part of the side surface of the microphone unit 12*a* along a height direction of the microphone unit 12*a* and having an outer appearance of a barrel shape. The microphone unit 12*a* is a directive microphone, and the microphone unit 12*b* is a non-directive microphone. A sound pickup surface 12*a*1 of the microphone unit 12*a* has an approximate circular shape, and a sound pickup surface 12*b*1 of the microphone unit 12*b* has an approximate semicircular shape. The sound pickup surfaces 12*a*1 and 12*b*1 of the microphone unit 12*a* and the microphone unit 12*b* are at approximately the same height with reference to the height direction of the microphone unit 12*a*. Each of the microphone unit 12*a* and the microphone unit 12*b* is formed, for example, from a capacitor microphone (electret capacitor microphone), and comprises a vibration plate (movable electrode or diaphragm), a fixed electrode (back plate), and an insulator. The vibration plates are respectively placed close to the sound pickup surfaces 12*a*1 and 12*b* 1, and are placed at approximately the same height with reference to the height direction of the microphone unit 12*a*.

In the present embodiment, as shown in FIGS. 1A, 1B, and 2, the microphone units are placed such that the microphone units 12*b* and 14*b* are at an outer side and the microphone units 12*a* and 14*b* are at an inner side, but alternatively, the placement may be reversed, and the microphone units 12*b* and 14*b* may be placed at an inner side and the microphone units 12*a* and 14*a* may be placed at an outer side.

Figure 4:
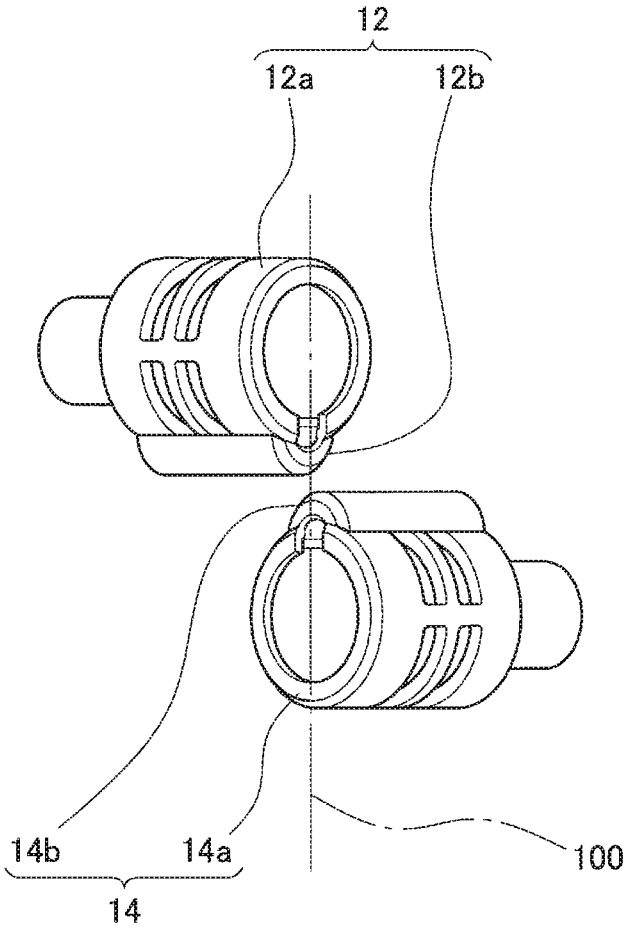
FIG. 4 is an explanatory diagram of a placement of a microphone unit according to another embodiment of the present disclosure.

FIG. 4 is a plan view showing the placement of the microphone units in this configuration. The left microphone unit 12 includes the microphone unit 12*a* and the microphone unit 12*b*, and the right microphone unit 14 similarly includes the microphone unit 14*a* and the microphone unit 14*b*. Unlike FIG. 2, the microphone units 12*b* and 14*b* are fixed at an inner side with respect to the microphone units 12*a* and 14*a*. The placement of FIG. 4 may be considered as a placement which places more emphasis on the prevention of middle omission of the sound of higher than or equal to 40 kHz, compared to the placement of FIG. 2.

In addition, in the present embodiment, both the left microphone unit 12 and the right microphone unit 14 may be pivotally supported in a rotatable manner, to achieve a configuration where the placement of FIG. 2 and the placement of FIG. 4 may be switched according to the user's preferences. Specifically, the left microphone unit 12 and the right microphone unit 14 are respectively pivotally supported in a rotatable manner on a bearing provided at an inner circumferential surface of a fixing based attached to the portable sound recording apparatus 10, and are set to be rotatable about the central axes of the left microphone unit 12 and the right microphone unit 14 having an approximate circular tube shape, respectively.

Further, in the present embodiment, each of the left microphone unit 12 and the right microphone unit 14 comprises the microphone unit which primarily collects sounds of lower than 40 kHz and the microphone unit which primarily collects sounds of higher than or equal to 40 kHz, but the present embodiment is not limited to such a configuration, and each of the left microphone unit 12 and the right microphone unit 14 may be formed from a microphone unit which collects sounds of a relatively low band and a microphone unit which collects sounds of a relatively high band. In other words, a threshold frequency of sound pickup ranges of the high-band microphone unit and the low-band microphone unit may vary depending on the characteristics of the microphones to be combined, and the high-band microphone unit may include sounds of lower than or equal to 40 kHz or the low-band microphone unit may include sounds of higher than or equal to 40 kHz. In this case, each of the left microphone unit 12 and the right microphone unit 14 of the portable sound recording apparatus comprises a microphone unit which collects sounds of a relatively low band and a microphone unit which collects sounds of a relatively high band, and the vibration plate of the high-band microphone unit of the left microphone unit 12, the vibration plate of the low-band microphone unit of the left microphone unit 12, the vibration plate of the high-band microphone unit of the right microphone unit 14, and the vibration plate of the low-band microphone unit of the right microphone unit 14 are placed on the same straight line in a plan view. In FIGS. 1A~4, the microphone units 12*a* and 14*a* correspond to the low-band microphone units, and the microphone units 12*b* and 14*b* correspond to the high-band microphone units. More specifically, in FIGS. 1A~4, the left microphone unit 12 includes the low-band, directive microphone unit 12*a* and the high-band, non-directive microphone unit 12*b*, and the right microphone unit 14 includes the low-band, directive microphone unit 14*a* and the high-band, non-directive microphone unit 14*b*.

In the present embodiment, the descriptions of "placement on the central axis 100" and "placement on the same straight line" do not necessarily require a strict placement, and a certain error or allowance may be allowed. Thus, it is sufficient that the vibration plates of a total of four microphone units (more specifically, the centers of the vibration plates) are placed on approximately the same straight line in the plan view.

In addition, in the present embodiment, the microphone unit 11 may be attached on the portable sound recording device body so that the microphone unit 11 is rotatable about an axis which is the same straight line on which the vibration plates of the microphone units 12*a*, 12*b*, 14*a*, and 14*b* are placed, to allow adjustment of a crossing angle of the microphone unit 11.

Further, even when each of the left microphone unit 12 and the right microphone unit 14 includes three or more microphone units (for example, a low-band microphone unit, a middle-band microphone unit, and a high-band microphone unit), the present embodiment can be similarly applied. In this case, desirably, the low-band microphone unit, the middle-band microphone unit, and the high-band microphone unit are all placed on the same straight line. However, as it is possible to compensate for the sound pickup range of the middle-band microphone unit, the middle omission phenomenon in the high-res sound source can be suppressed when at least the low-band microphone unit and the high-band microphone unit are placed on the same straight line.

The invention claimed is:

1. An XY-type microphone unit in which a pair of left and right microphones are placed with respective sound pickup axes substantially crossing each other, the XY-type microphone unit comprising:

a left microphone unit; and a right microphone unit, wherein the left microphone unit comprises at least:

a high-band microphone unit of the left microphone unit that collects sounds of a relatively high band; and a low-band microphone unit of the left microphone unit that collects sounds of a relatively low band, the right microphone unit comprises at least:

a high-band microphone unit of the right microphone unit that collects sounds of a relatively high band; and a low-band microphone unit of the right microphone unit that collects sounds of a relatively low band, and vibration plates of the high-band microphone unit of the left microphone unit, the low-band microphone unit of the left microphone unit, the high-band microphone unit of the right microphone unit, and the low-band microphone unit of the right microphone unit are placed on approximately the same straight line in a plan view.

2. The XY-type microphone unit according to claim 1, wherein the high-band microphone unit of the left microphone unit is fixed at a predetermined position of the low-band microphone unit of the left microphone unit, the high-band microphone unit of the right microphone unit is fixed at a predetermined position of the low-band microphone unit of the right microphone unit, and the high-band microphone unit of the left microphone unit and the high-band microphone unit of the right microphone unit are placed at an outer side in a plan view with respect to the low-band microphone unit of the left microphone unit and the low-band microphone unit of the right microphone unit.

3. The XY-type microphone unit according to claim 1, wherein the high-band microphone unit of the left microphone unit is fixed at a predetermined position of the low-band microphone unit of the left microphone unit, the high-band microphone unit of the right microphone unit is fixed at a predetermined position of the low-band microphone unit of the right microphone unit, and the high-band microphone unit of the left microphone unit and the high-band microphone unit of the right microphone unit are placed at an inner side in a plan view with respect to the low-band microphone unit of the left microphone unit and the low-band microphone unit of the right microphone unit.

4. The XY-type microphone unit according to claim 1, wherein the high-band microphone unit of the left microphone unit is fixed at a predetermined position of the low-band microphone unit of the left microphone unit, the high-band microphone unit of the right microphone unit is fixed at a predetermined position of the low-band microphone unit of the right microphone unit, and the high-band microphone unit of the left microphone unit and the high-band microphone unit of the right microphone unit are placed in a manner to allow switching between an outer side and an inner side in a plan view with respect to the low-band microphone unit of the left microphone unit and the low-band microphone unit of the right microphone unit.

5. The XY-type microphone unit according to claim 1, wherein the high-band microphone unit of the left microphone unit and the high-band microphone unit of the right microphone unit collect sounds of higher than or equal to 40 kHz, and the low-band microphone unit of the left microphone unit and the low-band microphone unit of the right microphone unit collect sounds of lower than 40 kHz.

6. A sound recording apparatus comprising the XY-type microphone unit according to claim 1.

* * * * *